US007407355B2

(12) United States Patent
Schmidkonz et al.

(10) Patent No.: US 7,407,355 B2
(45) Date of Patent: Aug. 5, 2008

(54) METHOD AND DEVICE FOR AUTOMATICALLY BINDING BOOK BLOCKS BY MACHINE IN A WORKING CYCLE

(75) Inventors: Peter Schmidkonz, Nittenau (DE); Uwe Matthes, Bitz (DE)

(73) Assignee: Bielomatik L.O.S. GmbH, Nittenau (DE)

( * ) Notice: Subject to any disclaimer, the term of this patent is extended or adjusted under 35 U.S.C. 154(b) by 652 days.

(21) Appl. No.: 10/488,094

(22) PCT Filed: Aug. 30, 2002

(86) PCT No.: PCT/DE02/03183

§ 371 (c)(1),
(2), (4) Date: Jul. 7, 2004

(87) PCT Pub. No.: WO03/022596

PCT Pub. Date: Mar. 20, 2003

(65) Prior Publication Data

US 2004/0240964 A1 Dec. 2, 2004

(30) Foreign Application Priority Data

Sep. 6, 2001 (DE) ..... 101 44 180

(51) Int. Cl.
*B42C 11/00* (2006.01)

(52) U.S. Cl. ..... 412/4; 412/8; 412/19; 412/24

(58) Field of Classification Search ..... 412/1, 412/4, 5, 8, 19, 24, 31; 270/52.18, 52.08, 270/58.02

See application file for complete search history.

(56) References Cited

U.S. PATENT DOCUMENTS 4,552,497 A * 11/1985 Kockler et al. ..... 412/6

(Continued)

FOREIGN PATENT DOCUMENTS

DE 20 16 425 10/1971

(Continued)

*Primary Examiner*—Willmon Fridie, Jr.
(74) *Attorney, Agent, or Firm*—Hoffman, Wasson & Gitler, P.C.

(57) ABSTRACT

This invention relates to a method and a device for automatically binding book blocks by machine. In a working cycle, the book blocks are conveyed on a conveyor device in an upright manner through the individual processing stations. In a fanning gluing binding station (2), adhesive is applied from underneath against the fanned book block spine. In a spine-taping station (3) the spine-taping material is directly pulled off a roll and is automatically cut to the predetermined measure by machine. The headband is likewise pulled off a roll, cut to the required dimensions, advanced to the book block by means of a slide and is ironed onto the book spine. Afterwards, the end paper of the book block provided with the headband is opened in order to attach the book cover to the book block, is pulled from the book block by suction, and is clamped in a lower station press. With the end paper opened, the book block is then placed in a covering station (5), and the book block is fixed to the book cover. In a rounding station (7) the book is detected by strip clamping devices located on both sides, and the book block is held by a loop located between both clamping devices and is rounded by a laterally advanced shaped member. The book, which is provided with a cover and whose spine is rounded, is banded in a banding station (8) and the rounding given to the book is permanently fixed.

7 Claims, 10 Drawing Sheets

U.S. PATENT DOCUMENTS 5,108,244 A * 4/1992 Bellanca ..... 412/37
5,237,898 A * 8/1993 Kubisiak ..... 83/227
5,702,219 A * 12/1997 Hattori ..... 412/6
6,682,062 B2 * 1/2004 Graushar et al. ..... 270/1.02
6,717,286 B2 * 4/2004 Tsuchiya et al. ..... 270/58.07
7,082,980 B2 * 8/2006 Silverbrook ..... 156/578
2002/0089111 A1 * 7/2002 Tsuchiya et al. ..... 270/58.08

FOREIGN PATENT DOCUMENTS

DE 43 34 225 4/1995

* cited by examiner

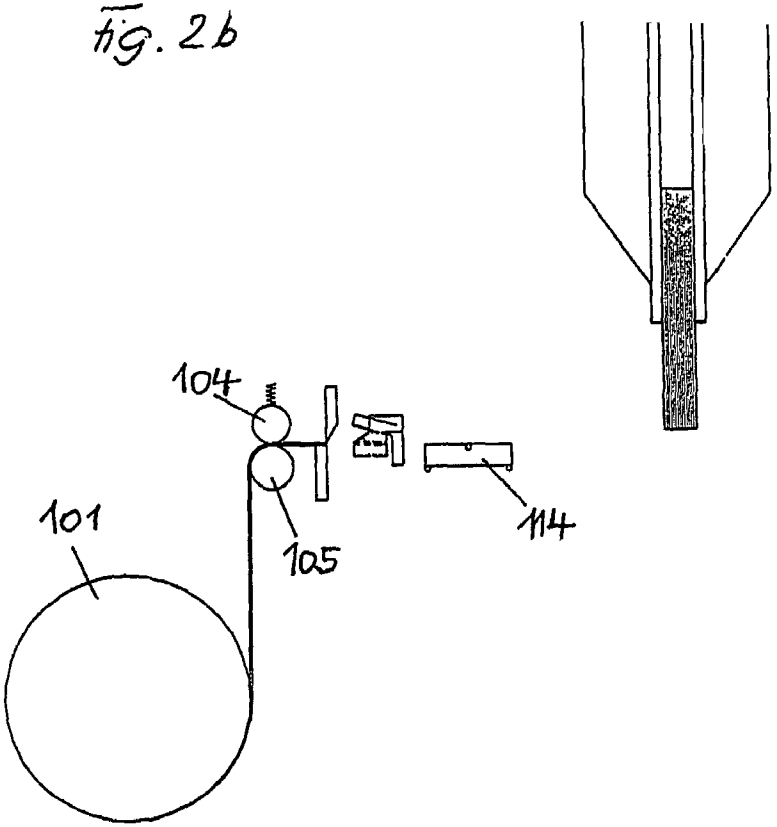
fig. 2b
fig. 2
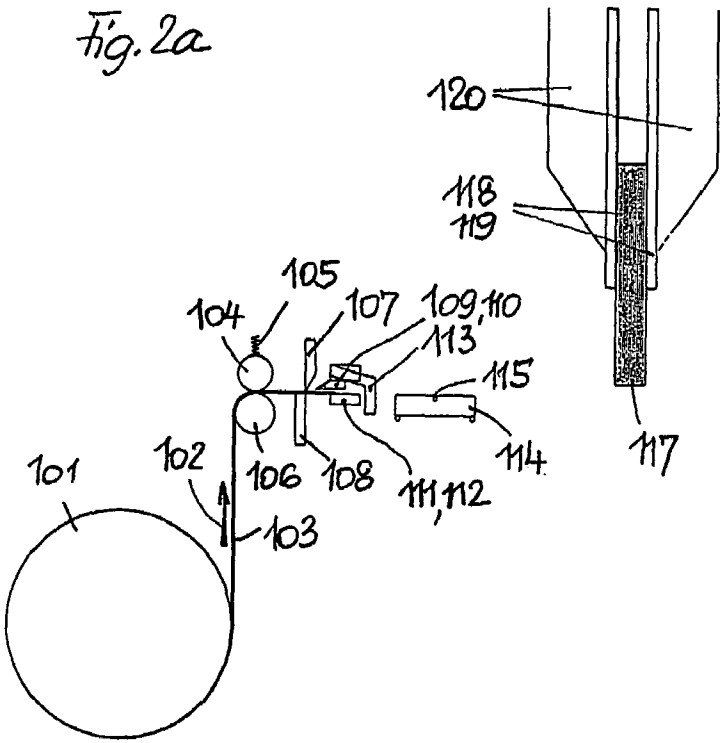
fig. 2a

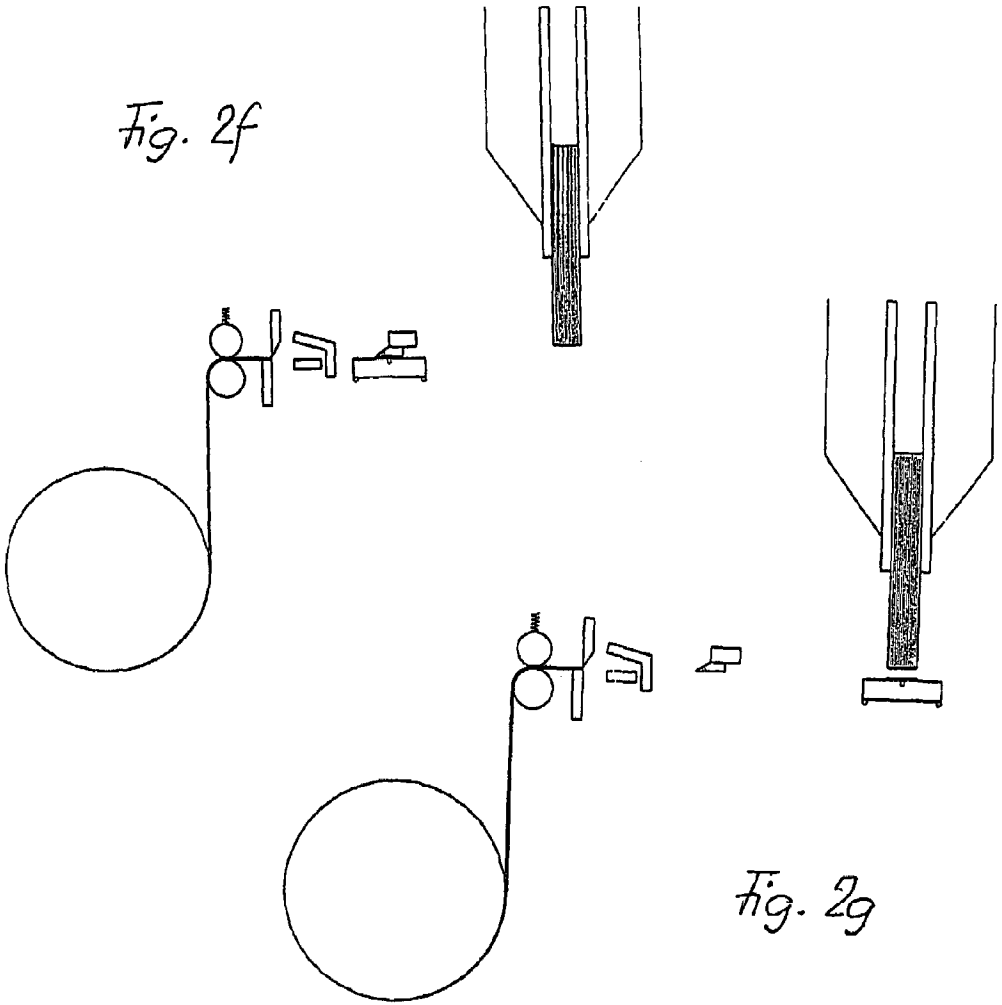
Fig. 2f
Fig. 2g
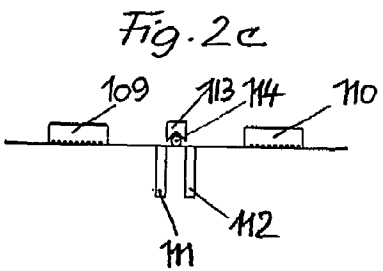
Fig. 2c
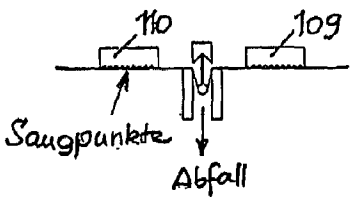
Fig. 2d
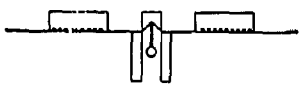
Fig. 2e 116
131
132
133
134
135
136
121

138
137

139
140

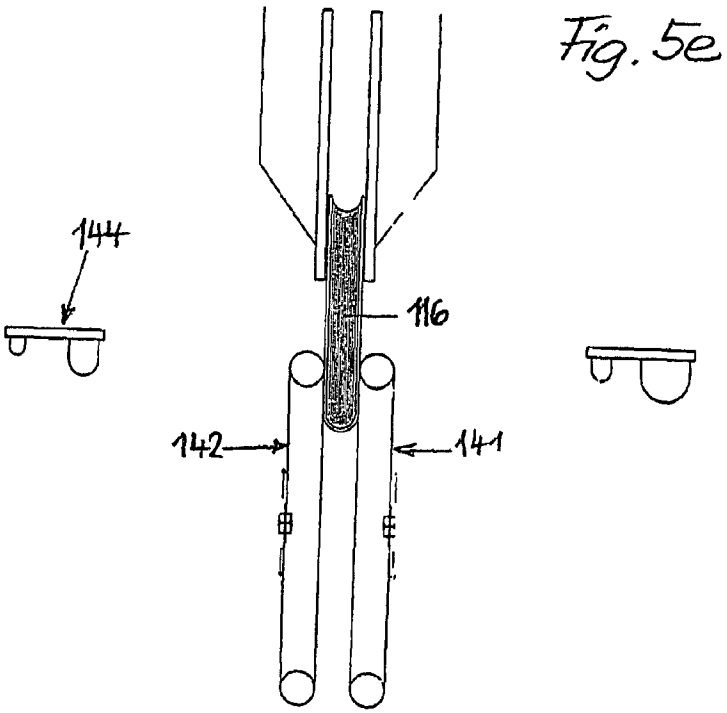
Fig. 5
Fig. 5e
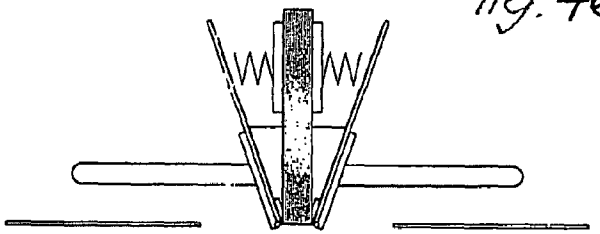
Fig. 4e
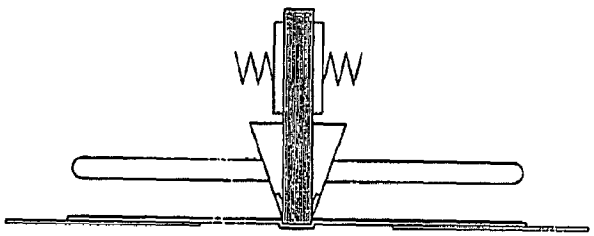
Fig. 4f

METHOD AND DEVICE FOR AUTOMATICALLY BINDING BOOK BLOCKS BY MACHINE IN A WORKING CYCLE

Methods and machines for automatically binding book blocks on mass production cannot be transferred to workmanlike or high quality individual production because with a production line for binding books in large quantities the time necessary for reassembling the production line and the standstill times associated thereto would be entirely uneconomical.

It is an object of this invention to produce book covers for unique specimen, individual books and small series by machine and by automatic production as a high quality product, which compared with the art of craftsmanship in book binding is by no means inferior, to design the possibilities of variations and the manifold of the books to be bound by automatic production as extensive as possible, and to improve the time and cost expenditure for binding an individual book compared with hand-made books to a considerable extent.

According to the subject invention this object is solved by a method according to which a) the book blocks to be bound in an input station are clamped in series onto a conveying means fastened to a continuous support rail, and are transported through the individual treatment and processing stations in an upright position in time with the processing cycles;

b) in a fanning gluing binding station glue is applied from below onto the book block spine,, whereby applying the glue is performed by a press-on device so that the sheets of the book block on their spine are fanned in the one and subsequent thereto in the other direction and at the same time glue is applied to the fanned spine of the book block;

c) in a spine-taping station the spine-taping material is applied onto the spine of the book block and is glued thereon, the spine-taping material is pulled-off from a roll and is automatically cut to the predetermined measure by machine;

d) within a station for applying a headband the headband is applied onto the passing book block and is pulled-off from a roll according to stored data, is cut to the predetermined dimensions, the cut-off headband section is transported to the book block by means of a slide and is ironed onto the book spine;

e) within a station for opening the end paper the book block provided with the headband is opened at the book block for subsequently applying the book cover in such a manner that the end paper of the book block is withdrawn from the transport press by a suctioning effect, and can be firmly clamped by a press engaging the book block in its lower area;

f) within a book block station and with opened end paper the book cover is applied and is fixed to the book cover, whereby the end paper is bonded to the cover by heating and gluing;

g) within a rounding station the book is released from the transport press and is engaged by band clamping devices located on both sides, the book block is supported by means of a loop or similar support means located between both clamping devices, and is rounded by a laterally advanced shaped member, and subsequent thereto the book block is transferred to the transport press again by said band clamping devices, and h) in a banding station the book provided with the cover and rounded on the spine is banded so that the rounding given the book is permanently fixed by maintaining the rounding within the book until the layer of glue is cured.

Furthermore, according to the invention a device is proposed which is characterised in that a) the book blocks to be bound in an input station are clamped in series onto a conveying means fastened to a continuous support rail, and are transported through the individual treatment and processing stations in an upright position in time with the processing cycles;

b) in a fanning gluing binding station glue is applied from below onto the book block spine, whereby applying the glue is actuated by a press-on device so that the sheets of the book block on their spine are fanned in the one and subsequent thereto in the other direction and at the same time glue is applied to the fanned back of the book block;

c) in a spine-taping station the spine-taping material is applied onto the spine of the book block and is glued thereon, the spine-taping material is pulled-off from a roll and is automatically cut to the predetermined measure by machine;

d) within a station for applying a headband the headband is applied onto the passing book block and is pulled-off from a roll according to stored data, is cut to the predetermined dimensions, the cut-off headband section is transported to the book block by means of a slide and is ironed onto the book spine;

e) within a station for opening the end paper the book block provided with the headband is opened at the book block for subsequently applying the book cover in such a manner that the end paper of the book block is withdrawn from the transport press by a suctioning effect, and can be firmly clamped by a press engaging the book block in its lower area;

f) within a book block station and with opened end paper the book cover is applied and is fixed to the book cover, whereby the end paper is bonded to the cover by heating and gluing;

g) within a rounding station the book is released from the transport press and is engaged by band clamping devices located on both sides, the book block is supported by means of a loop or similar support means located between both clamping devices, and is rounded by a laterally advanced shaped part, and subsequent thereto the book block is transferred to the transport press again by said band clamping devices, and h) in a banding station the book provided with the cover and rounded on the spine is banded so that the rounding given the book is permanently fixed by maintaining the rounding within the book until the layer of glue is cured.

According to a further embodiment of this invention a folding station is arranged between the rounding station and the banding station. Within the folding station a fold is burnt-in on the book block with book cover by means of a folding machine, and the linen material covering the hot-melted and rounded spine of the book is pressed against the book block by applying pressure and heat, the hot melt process is intensified, and the fold is stabilized and formed so that an additional safety aspect is obtained for the end paper.

Further embodiments of the invention are the subject matter of the subclaims.

With a method and a device according to the invention the book blocks can be inserted into the device in one working cycle and can be delivered as a ready bound book; between inputting and outputting all operations can be performed automatically which are required for the binding of individual books. Accordingly, this type of book binding device comprises the following stations: Input, fanning gluing binding, spine taping, applying the headband, inserting the cover, hot-melting, rounding the spine, eventually folding by burning-in and banding.

In the following preferred embodiments of the invention are described in combination with the drawings, in which:

FIG. 2 shows the machine part according to FIG. 1, which includes applying the headband in individual operational steps according to FIGS. 2*a*-2*g;*

Figure 1:
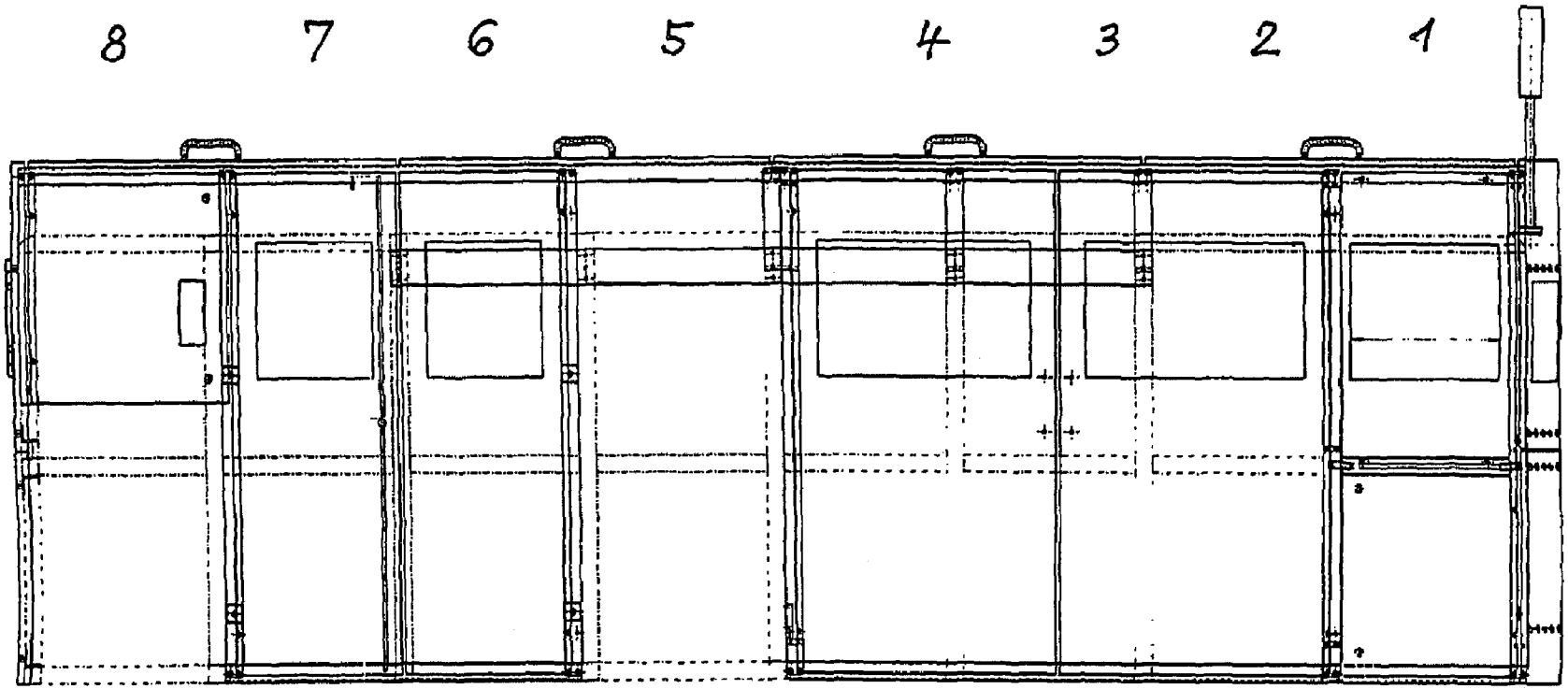
FIG. 1 shows a schematic representation of the individual stations of a device according to the invention.

FIG. 1 shows a schematic representation of the basic structure of the book binding device according to the invention comprising an input station 1, a station 2 for fan binding by gluing the fanned book block, a station 3 for spine-taping, a station 4 for applying the headband and for opening the end paper, a station 5 for inserting the cover, a station 6 for hot-melting, a station 7 for rounding the book spine and a station 8 for banding.

A device 2 for binding by gluing the fanned book block is the subject matter of German patent application 199 22 100.6 (equivalent to U.S. patent application Ser. No. 09/926 538) so that this device does not need to be described in detail.

The representation according to FIG. 2 (FIGS. 2*a*-2*g*) shows the process of applying the headband onto the book block spine. The headband 103 is withdrawn from a reel 101 in the direction 102 of the passage between a driving roller 104 with a controlled axis for adjusting the width, whereby the axis is spring-tensioned at 105, and a counter-pressure roller 106 and is passed onto a cutting device 107, 108 consisting of a movable cutting knife 107 and a stationary counter-knife 108. Associated to the cutting device are suction shoes 109, 110, which engage the free end of the tape, and which are provided with lower knives 111, 112 as well a hook-type upper knife 113. Sliding means 114 with suction elements 115 are connected to the cutting device 111-113. The cutting knife 107 separates the band 103. The separated length of the band 103 is transferred to the slide 114 by means of the suction shoe 109 and the hook 113 and is restrained there at the suction point 115. The slide 114 is moved underneath the book block 116, is pressed against the book spine 117 and is ironed thereon. The book block 116 is restrained by clamping plates 118, 119, which are part of the transport press 120, when being passed through the machine. The transport press 120 is attached to a carriage (not shown), which is mounted on a support rail (not shown) passing through the entire machine.

Figure 3:
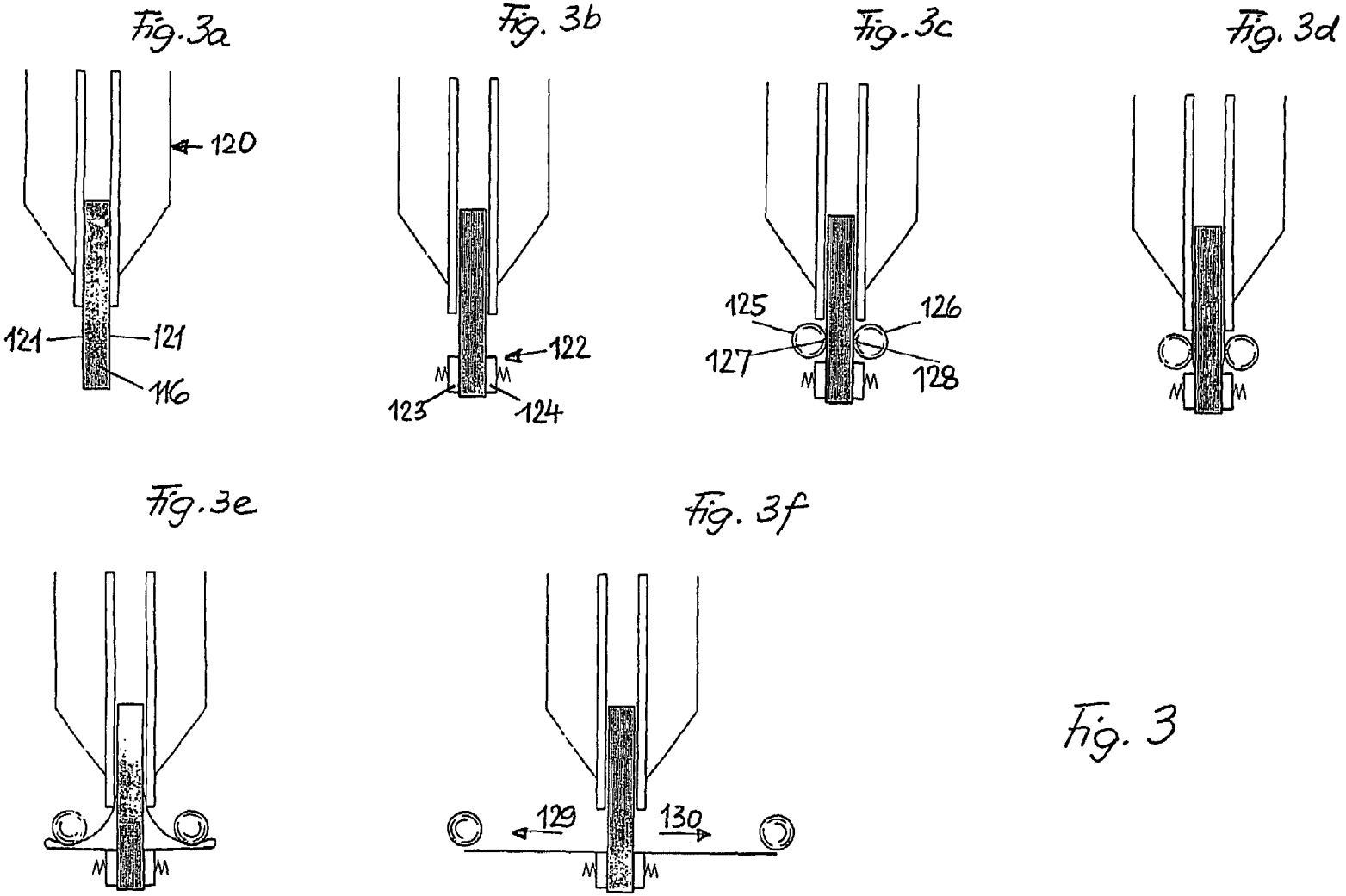
FIG. 3 shows the means for opening the end paper which is to be connected with the cover in a clamped condition, and especially in different instantaneous representations of the operation according to FIGS. 3*a*-3*f;*

That part of the device which performs the opening of the end paper, is shown in FIG. 3; its operation mode results from the operational steps shown in FIGS. 3*a*-3*f*. When arriving in station 4 the book block 116, which already has been provided with the end paper 121 when entering the device, is released from the transport press 120 after the book block (with end paper) has been overtaken by a station press 122 or alternatively by the pre-tensioned clamping jaws 123, 124 at its lower end. If this clamping process has been completed, suction rollers 125, 126 formed as hollow shafts are adjusted towards the book block from outside, which rollers are provided with suction openings 127, 128. The suction rollers 125, 126 are rotated and exert a suction effect onto the end paper 121, which is withdrawn from the book block 116, if the suction rollers are laterally moved away from each other (arrows 129, 130). As shown in FIG. 3*e*, this has the result that the end paper is withdrawn from the book block in a loop-type path and finally (FIG. 3*f*) is moved into a substantially horizontal position.

Figures 4, 4A, 4B, 4C, 4D:
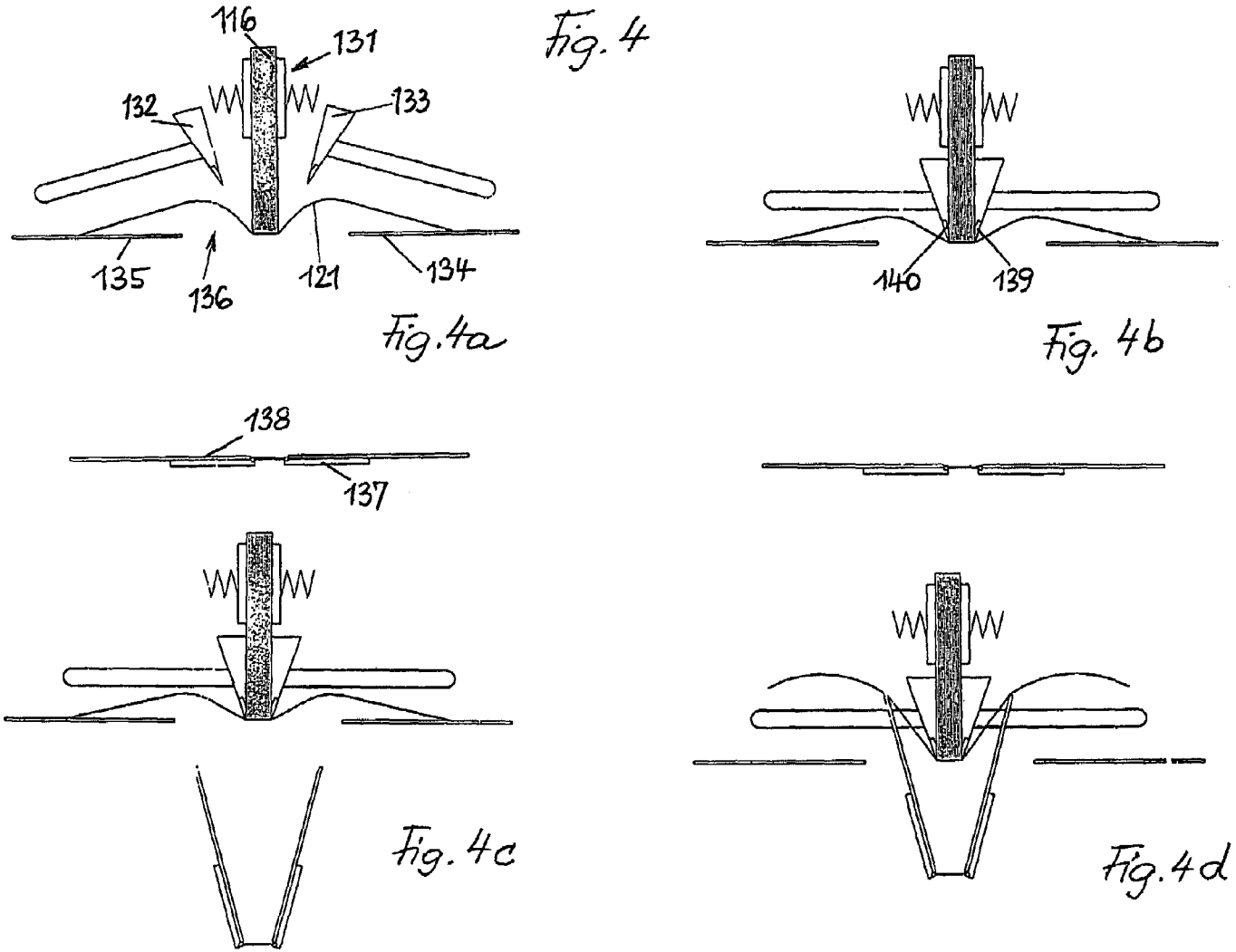
FIG. 4 shows the means for combining the cover with the book block and for fixing the cover to the book block, according to steps 4*a*-4*f;*
Figure 5B:
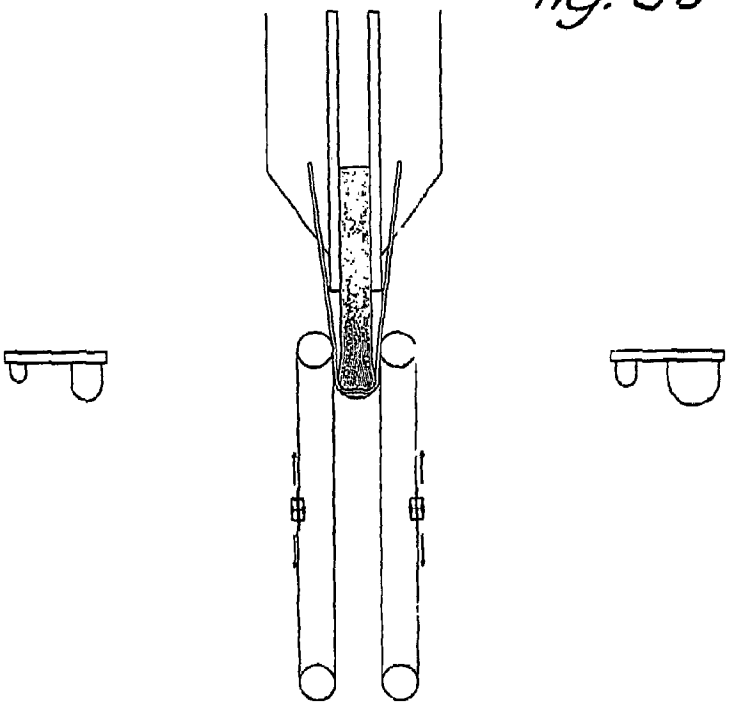
FIG. 5 shows the means for rounding the book block with the operational steps according to FIGS. 5*a*-5*e;*
Figure 5A:
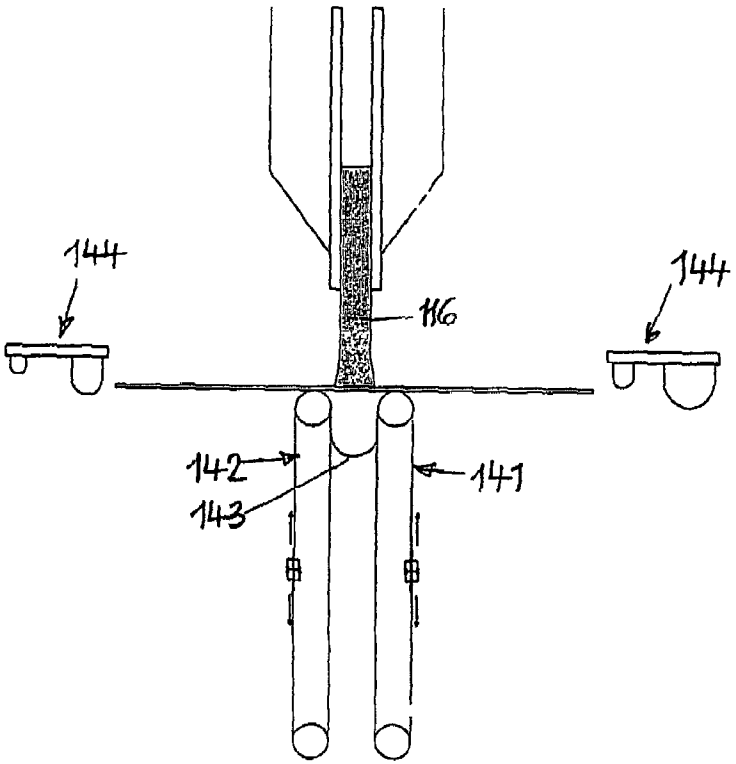
Figure 5D:
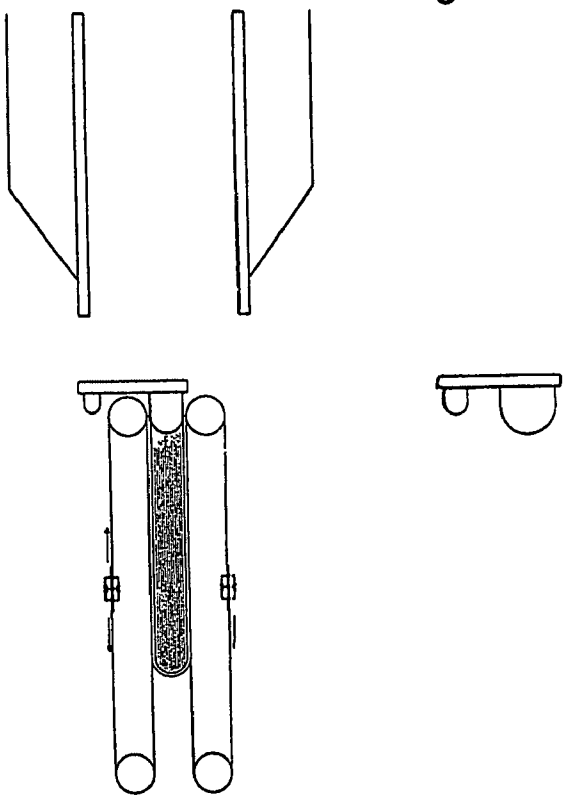
Figure 5C:
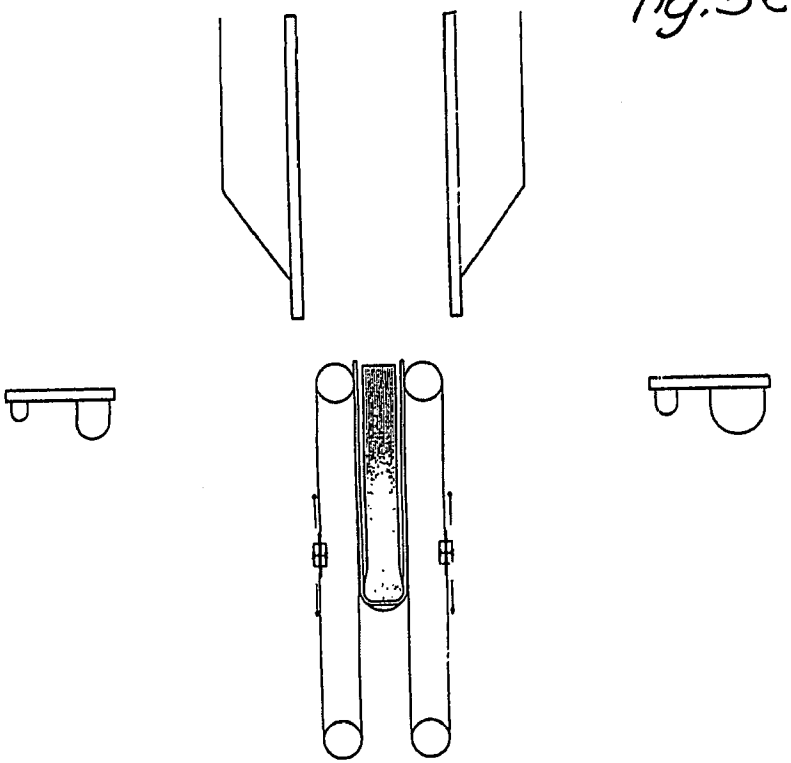

Now, according to FIG. 4 (FIGS. 4*a*-4*f*) within station 5 the book cover is applied and attached to the book block with the end paper open,. The book block 116 is overtaken by a station press 131 provided on both sides with support and heating elements 132, 133, which can be swung away and are adjustable relative to the book block. The end paper rests upon support sheets 134, 135 which are open (at 136) adjacent the book block. The book cover 138 passed from the bottom onto a support 137 is moved upwardly through the opening 136 in such a manner that with this movement the end paper is taken along, is moved towards the book block and finally is in contact with the inner sides of the book cover. Then, means 139, 140, for example heating cartridges, are applied onto the inner sides of the book cover, which cartridges activate the hot-melt material and thus bond the end paper and the book cover together.

In station 7 the book block being inserted in the cover is rounded and is locked within the transport press. The book cover fixed on the book block, and folded up substantially in horizontal direction engages both-sided, continuous conveyor belts 141, 142, which in peripheral direction are separated and can be screwed together at the separation position, and which between them have a loop 143 at the upper end facing the book spine, which loop receives and supports the book spine. The transport press releases the book, which now is supported by both conveyor belts and is moved downwardly between the two belts to such an extent that the upper narrow side of the book block is arranged substantially flush with the upper edge of the conveyor belts. Subsequent thereto, a shaping device 144 is moved across the book block, the shape of which corresponds with the required rounding of the book block, and is pressed against the book block fixed by the conveyor belts so that the free, narrow front side of the book block receives the shape of the shaping device, and so that the book spine will be rounded accordingly. Then, the book is lifted again by means of the two conveyor belts and is received and clamped by the transport press. In this way, the book on the transport chain is moved into the banding station 8 in which the book is closely surrounded by means of a banding strip so that the rounding given to the book will be maintained until the glue is cured.

Figure 6:
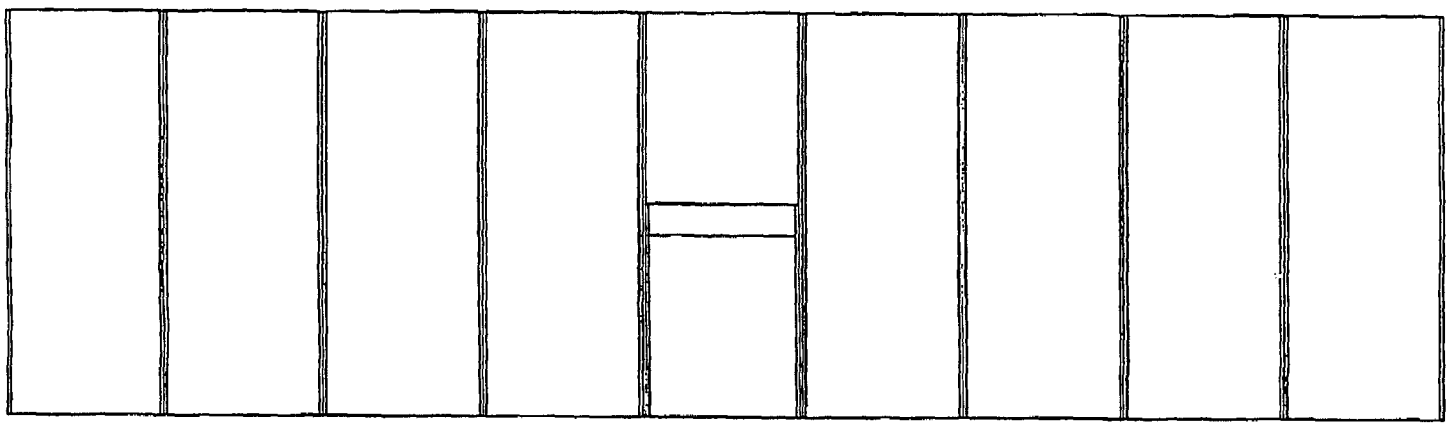
FIG. 6 shows a schematic representation of a further embodiment of the invention according to FIG. 1.
Figure 7:
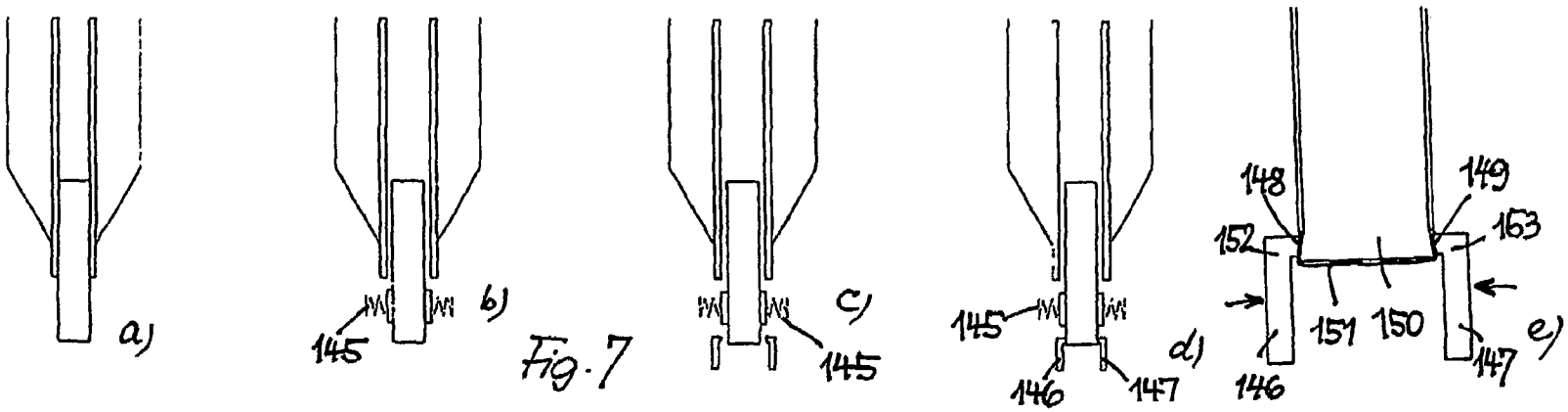
FIG. 7 shows the means for burning-in the folds.

FIG. 6 shows the method steps according to FIG. 1, whereby between the rounding station 7 and the banding station (in FIG. 6 marked with 9) the folding station 8 (station for burning-in the folds) is provided. In this station the book block with the inserted cover is transmitted to the station 8 by means of a gripping carriage, which station 8 in case of FIG. 6 is the folding station (shown by steps a)-d) of FIG. 7), whereby the picture according to FIG. 7*e* shows in a larger scale the engagement of the ledges for burning the fold into the book block. A lower press 145 grips and overtakes the book block 116. Subsequent thereto, the gripping carriage releases the book block again. Then, the fold ledges 146, 147 are fastened into their position and at the height of the fold are moved towards each other and are put under pressure against the book block and are heated. In view of this pressure and heat treatment and caused by the engaging surfaces 148, 149 of the ledges 146, 147, which are arranged inclined in view of the book block plane, the outwardly fanned book block spine 150 is compressed from both sides in the direction of the arrow and the fold is burnt-in; the outer side of the book block spine is provided with a linen layer. The end sections 152, 153 of the fold ledges 146, 147, which engage the book block, preferably are electrically heated (not shown).

Figure 8:
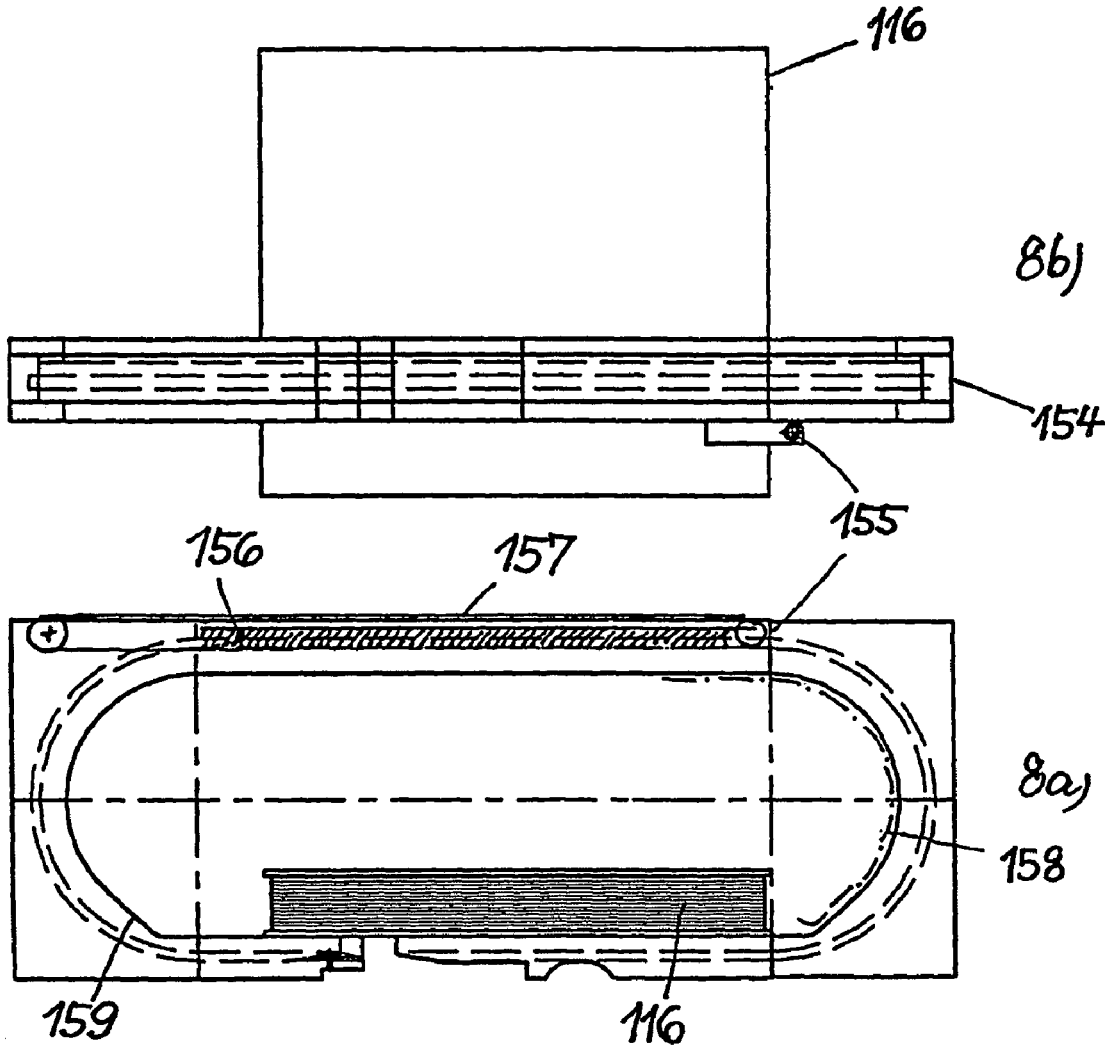
FIG. 8 shows an embodiment of the means for banding.

The device according to FIG. 8 shows an embodiment of means for banding. FIG. 8*a* is a top view on said device, FIG. 8*b* is a lateral view. For banding the book block 116 is inserted into a frame, which embraces the book block like a loop and is in contact with the frame on one side. Frame 154 can be opened by a hinge 155 or a swiveling device so that the books to be banded can be arranged within the open frame. Subsequent thereto the frame is locked. For example, a suction box 156 with a suction band 157 is provided within the frame 154 at the side opposite to the book block, which suction means causes the transport of the banding strip. Based on the suction effect generated therefrom a movement of the banding strip 158 within an air path 159 is obtained in a contact-free manner so that any abrasion of the strip material is dispensed with and in view of the lack of mechanical contact with a guideway a high speed of transportation of the strip will be obtained. Therefore, the banding strip 158 is transported within the air passageway 159 by means of an air cushion.

The invention claimed is:

1. Method for automatically binding book blocks by machine in one working cycle, characterised in that a) the book blocks to be bound in an input station are clamped in series onto a conveying means fastened to a continuous support rail, and are transported through the individual treatment and processing stations in an upright position in time with the processing cycles;

b) in a fanning glueing binding station glue is applied from below onto the book block spine, whereby applying the glue is performed by a press-on device so that the sheets of the book block on their spine are fanned in the one and subsequent thereto in the other direction and at the same time glue is applied to the fanned spine of the book block;

c) in a spine-taping station the spine-taping material is applied onto the spine of the book block and is glued thereon, the spine-taping material is pulled-off from a roll and is automatically cut to the predetermined measure by machine;

d) within a station for applying a headband the headband is applied onto the passing book block and is pulled-off from a roll according to stored data, is cut to the predetermined measure, the cut-off headband section is transported to the book block by means of a slide and is ironed onto the book spine;

e) within a station for opening the end paper the book block provided with the headband is opened at the book block for subsequently applying the book cover in such a manner that the end paper of the book block is withdrawn from the transport press by a suctioning effect, and can be firmly clamped by a press engaging the book block in its lower area;

f) within a book block station and with opened end paper the book cover is applied and is fixed to the book cover, whereby the end paper is bonded to the cover by heating and gluing;

g) within a rounding station the book is released from the transport press and is engaged by bamd clamping devices located on both sides, the book block is supported by means of a loop or similar support means located between both clamping devices, and is rounded by a laterally advanced shaped member, and subsequent thereto the book block is transferred to the transport press again by said band clamping devices, and h) in a banding station the book provided with the cover and rounded on the spine is banded so that the rounding given the book is permanently fixed by maintaining the rounding within the book until the layer of glue is cured.

2. Method according to claim 1, characterised in that the frame of the banding device can be opened at an interruption position for inserting the subjects to be banded, and that the banding strip is suctioned against the inner surface of the frame by a suctioning effect through suctioning openings, and is kept floating and is transported along the guideway.

3. Method according to claim 1, characterised in that between the process of rounding the book block and banding the rounded book the process of burning-in a fold is performed by a press acting from below against the book block, which book block subsequently is released from the gripper carriage, the fold ledges are moved into position and are pressurized against the book block at the height of the fold, and are heated.

4. Device for automatically binding book blocks by machine in a working cycle for carrying through the method according to claim 1, characterised in that a) the book blocks to be bound at an input station are clamped in series onto conveying means fastened to a continuous support rail, and are transported through the individual treatment and processing stations in an upright position in time with the processing cycles;

b) in a fanning gluing binding station glue is applied from below onto the book block spine, whereby applying the glue is performed by a press-on device so that the sheets of the book block on their spine are fanned in the one and subsequent thereto in the other direction and at the same time glue is applied to the fanned spine of the book block;

c) in a spine-taping station the spine-taping material is applied onto the spine of the book block and is glued thereon, the spine-taping material is pulled-off from a roll and is automatically cut to the predetermined measure by machine;

d) within a station for applying a headband the headband is applied onto the passing book block and is pulled-off from a roll according to stored data, is cut to the predetermined measure, the cut-off headband section is transported to the book block by means of a slide and is ironed onto the book spine;

e) within a station for opening the end paper the book block provided with the headband is opened at the book block for subsequently applying the book cover in such a manner that the end paper of the book block is withdrawn from the transport press by a suctioning effect, and can be firmly clamped by a press engaging the book block in its lower area;

f) within a book block station and with opened end paper the book cover is applied and is fixed to the book cover, whereby the end paper is bonded to the cover by heating and gluing;

g) within a rounding station the book is released from the transport press and is engaged by band clamping devices located on both sides, the book block is supported by means of a loop or similar support means located between both clamping devices, and is rounded by a laterally advanced shaped member, and subsequent thereto the book block is transferred to the transport press again by said band clamping devices, and h) in a banding station the book provided with the cover and rounded on the spine is banded so that the rounding given the book is permanently fixed by maintaining the rounding within the band until the layer of glue is cured.

5. Device according to claim 4, characterised in that the frame of the banding device is provided with interruption means for allowing the frame to be opened in order to insert the product to be banded, that the inner side of the closed frame is of substantially oval shape with rectilinear sections one of which forms a supporting surface for the products, that at least a further section of the frame along the inner periphery is provided with a guidance surface for suctioning the banding strip, and that the banding strip via suction openings adheres against the inner surface of the frame, is kept floating along said guidance surface and is transported.

6. Device according to claim 4, characterised in that the suction device is a suction box with a suction band, and that the section of the guidance surface of the frame facing the suction box or alternatively the suction box bottom is provided with suction openings distant from each other in the moving direction, which suction openings are arranged inclined and formed so that they transform the banding strip forwardly resting upon an air cushion.

7. Device according to claim 4, characterised in that between the rounding station and the banding station a folding station for burning-in the fold is provided, within which the ledges for burning-in the folds are arranged at both sides of the book block, and are heated and pressed against the book block.

* * * * *